United States Patent [19]

Tart et al.

[11] 4,098,942

[45] Jul. 4, 1978

[54] GASKET MATERIAL FORMED OF FELT CONTAINING POLYETHYLENE TEREPHTHALATE FIBERS

[75] Inventors: David K. Tart, Lenox, Mass.; Mitchell M. Osteen, Zirconia, N.C.

[73] Assignee: General Electric Company

[21] Appl. No.: 724,781

[22] Filed: Sep. 20, 1976

Related U.S. Application Data

[62] Division of Ser. No. 463,898, Apr. 25, 1974, Pat. No. 4,059,753.

[51] Int. Cl.[2] ..... D04H 1/08

[52] U.S. Cl. ..... 428/280; 428/296; 428/480

[58] Field of Search ..... 428/280, 288, 296, 300, 428/301, 480; 55/387, 522; 277/DIG. 6

[56] References Cited

U.S. PATENT DOCUMENTS

| | | | |
|---|---|---|---|
| 2,908,064 | 10/1959 | Lauterbach et al. | 428/300 |
| 2,910,763 | 11/1959 | Lauterbach | 428/300 |
| 2,958,113 | 11/1960 | Lauterbach | 428/300 |
| 4,029,955 | 6/1977 | Tart | 428/280 |

*Primary Examiner*—James J. Bell
*Attorney, Agent, or Firm*—Sidney Greenberg

[57] ABSTRACT

Felt gasket material comprising polyethylene terephthalate fibers and suitable for use in luminaires is provided with improved compression recovery properties at elevated operating temperatures of the luminaire by heating the gasket material preferably in the range of 160° C to 200° C for a sufficient time to heat-set the fibers.

3 Claims, 3 Drawing Figures

GASKET MATERIAL FORMED OF FELT CONTAINING POLYETHYLENE TEREPHTHALATE FIBERS

This a division of application Ser. No. 463,898 filed Apr. 25, 1974, now U.S. Pat. No. 4,059,753, and assigned to the same assignee as the present invention.

The present invention relates to a gasket material and more particularly to a felt gasket material comprising synthetic resin fibers suitable for use in electrical luminaires.

It is an object of the invention to provide an improved high temperature gasket material and a method of making the same.

It is a particular object of the invention to provide a felt gasket material of the above type which has improved compression recovery properties, especially when used at elevated temperatures and which is particularly suitable for use in electrical luminaires.

Other objects and advantages will become apparent from the following description and the appended claims.

With the above objects in view, the present invention in one of its aspects relates to a method of making gasket material having improved compression recovery characteristics under elevated temperature conditions which comprises the steps of providing a felt material comprising synthetic resin fibers, and heating the felt at a temperature of about 130° C–230° C for a sufficient time to appreciably increase the compression recovery thereof.

The invention will be better understood from the following description taken in conjunction with the accompanying drawing, in which.

Figure 1:
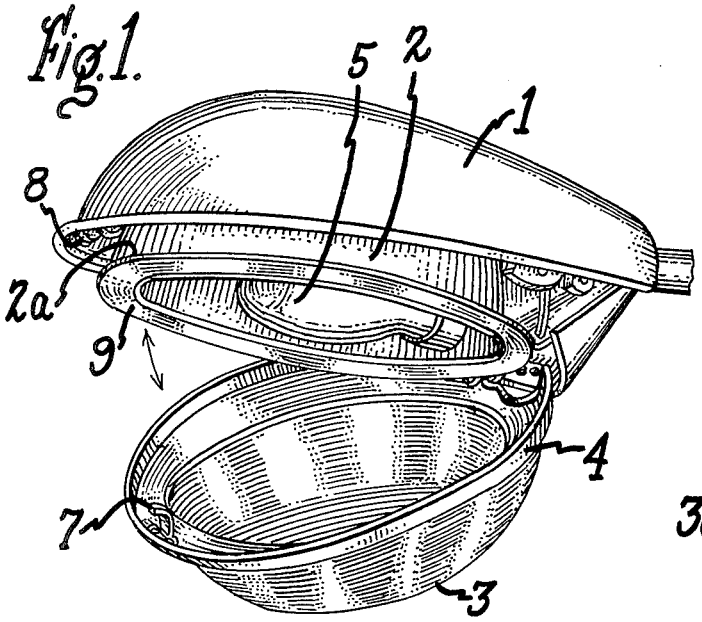
FIG. 1 is a perspective view of a luminaire equipped with a gasket which may embody the present invention.
Figure 2:
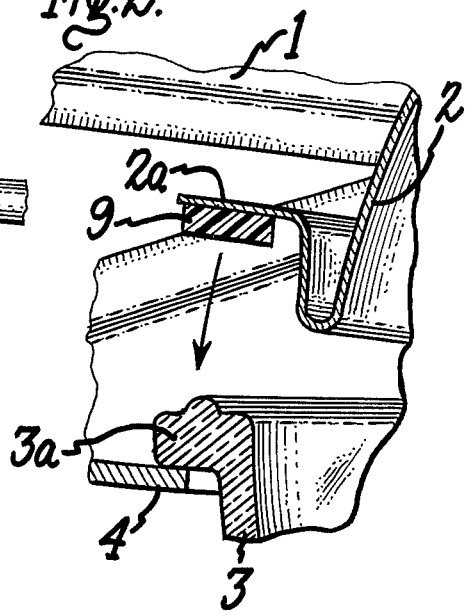
FIG. 2 is an enlarged detail view of the gasket arrangement in the FIG. 1 luminaire.

Referring now to the drawing and particularly to FIG. 1, there is shown a street lighting luminaire in which the invention is embodied and which comprises an upper housing 1 mounted at its rear end on a horizontal support. Arranged within the front portion of housing 1 is a concave reflector 2 typically made of aluminum and having a specular interior reflecting surface facing downwardly toward the bottom of the housing. Reflector 2 has a bottom flange 2*a* extending around its opening and is secured to the interior of housing 1 by suitable means (not shown). Lamp 5, typically a high-intensity gaseous discharge lamp, is suitably arranged within reflector 2. The open bottom of housing 1 is closed by refractor 3 mounted in an annular frame member 4 hingedly connected at its rear to housing 1. Frame member 4 is releasably attached at its front end by latch lever 7 on frame member 4 co-acting with latch plate 8 on housing 1. Refractor 3 is formed with an annular flange 3*a* (see FIG. 2) which in the closed position of frame member 4 comes into mating relation with reflector flange 2*a* and with air-permeable gasket 9 compressed therebetween. In the closed position, reflector 2 and refractor 3 define a closed optical enclosure into the interior of which air may pass through gasket 9. The gasket filter strip 9 produced in accordance with the invention may be attached to reflector flange 2*a* by any suitable means, such as by the use of suitable adhesive materials. Mechanical attaching means of various types may also be used, if desired.

Luminaires such as the type shown generate a substantial amount of heat during operation. For example, in luminaires using 400 watt lamps the operating temperature is about 120° C, while in those using 1000 watt lamps the operating temperature is in the vicinity of 150° C. When gaskets of conventional types are employed for providing a seal between reflector 2 and refractor 3, it has been found that compression of the gasket under such elevated temperature conditions and repeated opening and closing of refractor 3 against reflector 2 occasioned by necessary cleaning and relamping operations often lead to poor compression recovery of the gasket material. That is, the gasket strip becomes permanently compressed to some extent and thus leaves undesirable air gaps in the joint region. While certain gasket materials are known which can withstand such elevated temperature conditions, such materials are relatively expensive.

In accordance with the invention, gasket 9 is made of a felt strip comprising synthetic resin fiber material, particularly Dacron, which has been subjected to a heat treatment for heat-setting the fiber material to improve its compression recovery characteristics, especially under elevated temperature conditions. Dacron is the trademark for a thermoplastic polyester fiber made of polyethylene terephthalate, which has a melting point of about 250° C. While Dacron has been used for luminaire gasket material heretofore, its usefulness has been limited by poor compression recovery at temperatures higher than about 120° C. Felt gaskets of this material have been found to have a compression recovery which is about 79–80% at 120° C, and decreases rapidly at higher temperatures. Tests have shown that when such gaskets are used at 150° C, the compression recovery is less than 10%.

It has been found, in accordance with the invention, that the useful temperature limit of Dacron felt gaskets can be extended to at least 150° C by heat-setting the felt, whereby marked improvement in its compression recovery is obtained.

In general, the Dacron felt gasket may be heated in the range of about 130°–230° C to obtain improvement in its compression recovery characteristics, with a range of 160°–200° C being preferred. Heating at a temperature less than 130° C would require an impractically long period for the desired heat-setting to occur, whereas heating at temperatures higher than 230° C would entail the risk of unduly softening or melting the material.

The heat-setting (or thermo-setting) of resin fibers is well known and is described, for example, in the text entitled Preparation and Dyeing of Synthetic Fibers, by H. U. Schmidlin, published 1963 by Reinhold Publishing Corp., New York, Chapter 5.

In a typical process which may be used in practicing the invention, Dacron material in felted strip form ½ inch thick and having a density of about 2 lbs./yd.$^2$ is placed in a dry air oven preheated to 190° C and allowed to remain at that temperature for 1 to 2 hours. The felt is then removed from the oven and placed in a cool area to allow rapid cooling. It has been found that such a treatment wherein the felt is heated for two hours provides a compression recovery at 150° C of about 90%. This means that when the thus heatset Dacron felt is placed under 50% compression at 150° C, the felt returns to 90% of its original uncompressed thickness when released from compression.

The time of heating required to attain a particular degree of compression recovery will be longer the lower the temperature. Thus, at 130°–150° C more than 24 hours would be required to obtain a 90% compression recovery, whereas at 200°–230° C less than 2 hours and as little as 30 minutes would be needed to obtain the same results. Further, the greater the density of the felt, the longer the heating time required.

To obtain optimum compression recovery, i.e., 90%, it is desirable to heat-set the felt gasket at least about 30° C above the intended use temperature.

Since the Dacron felt will undergo a small amount of shrinkage as a result of the heat-setting process, allowance should be made for such shrinkage in the dimensions of the original felt strip in order to obtain the proper fit in the use of the treated felt as a gasket.

When Dacron felt gaskets of the type described are used in luminaires, as is shown in the drawing, they serve as air filters which trap particulate contaminants in the air to prevent them from entering the optical system of the luminaire. The present invention is also applicable to felt gaskets formed of a composite filter which may comprise Dacron and a carbonizable fiber material, e.g., Kynol, which is the trademark for a flame-resistant synthetic resin fiber composed of a thermosetting cross-linked phenol-formaldehyde polymer. Such composite filters, which serve to remove both particulate and gaseous contaminants in the air, are fully disclosed in the co-pending application of D. K. Tart, Ser. No. 440,698, filed Feb. 8, 1974, now abandoned and assigned to the same assignee as the present invention. The disclosure thereof is accordingly incorporated herein by reference.

Figure 3:
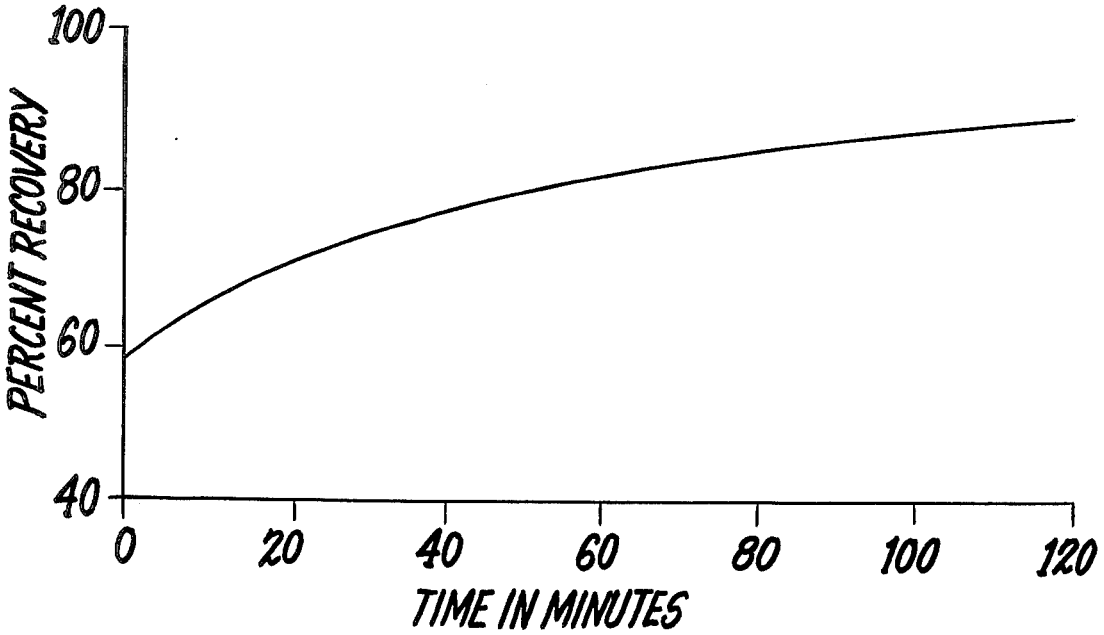
FIG. 3 is a graph illustrating the improvement in compression recovery of a felt gasket material with time of heating the material in accordance with the process of the invention.

Similar benefits in terms of improved compression recovery of such composite filters have been obtained by heat-setting such felt gasket material in accordance with the invention. In tests made on samples of a composite felt gasket formed of 70% Dacron and 30% carbonized Kynol, the samples were heated for various periods of time up to about 2 hours at a temperature of 190° C. The graph in FIG. 3, relating to these tests, in which the time of heating in minutes is plotted in relation to the present compression recovery, shows a general increase in compression recovery with time of heating from less than 60% prior to heat treatment to about 89% after two hours of heating. The compression recovery measurement was made after the heat-setting treatment and after the samples were subjected to 40% compression at a temperature of about 150° C.

It will be understood that the present invention is applicable to composite felts comprising Dacron and any of the carbonizable fiber components disclosed in the co-pending application.

In addition to the advantages provided by the invention in terms of enabling the use of a relatively inexpensive felt gasket material such as Dacron under conditions of compression at elevated temperatures, other benefits are that the gasket material may be used at high operating temperatures without further shrinkage, the shrinkage which takes place at the heat-setting temperatures locks in place the carbon particles of the carbonized fiber component in the composite filters as described, and the process of heat-setting renews the adsorbent surfaces of the carbonized fibers of composite filters by driving off any contaminants adsorbed thereby during storage or transportation prior to use as a gasket.

While the invention has been described primarily in connection with the use of felt material comprising Dacron, other synthetic resin fiber materials may be satisfactorily heat-set in accordance with the invention to obtain improved compression recovery and other properties. Such other fiber materials include, for example, the synthetic resin fiber material known as Nomex, which is the trademark for a heat resistant polyamide resin of nylon type and is composed of a copolymer of meta-phenylenediamine and isophthaloylchloride.

It also will be understood that the gasket material treated in accordance with the invention is not limited to use in electrical luminaires as described above, since it may be found useful in various other gasket applications to obtain good compression recovery characteristics under conditions of high operating temperature, and especially where the mating gasketed parts are separated and rejoined from time to time for any purpose.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. Gasket material having improved compression recovery characteristics under elevated temperature conditions formed of felt material comprising polyethylene terephthalate fibers which have been heated at a temperature of about 160°–200° C for at least 30 minutes to appreciably increase the compression recovery thereof.

2. Gasket material as defined in claim 1, said fiber material comprising polyethylene terephthalate being intermingled with second fiber material comprising a carbonized organic material.

3. Gasket material as defined in claim 2, said second fiber material comprising a phenol-formaldehyde polymer, said temperature is about 190° C and said time is at least 1 hour.

* * * * *